US006276642B1

(12) United States Patent
Young et al.

(10) Patent No.: US 6,276,642 B1
(45) Date of Patent: Aug. 21, 2001

(54) RAILROAD SPRING WING FROG ASSEMBLY

(75) Inventors: Keith Young, Naperville; Stephen R. Kuhn, Richton Park, both of IL (US)

(73) Assignee: ABC-NACO Inc., Downers Grove, IL (US)

( * ) Notice: Subject to any disclaimer, the term of this patent is extended or adjusted under 35 U.S.C. 154(b) by 0 days.

(21) Appl. No.: 09/521,339

(22) Filed: Mar. 9, 2000

(51) Int. Cl.[7] ..... B61K 13/00
(52) U.S. Cl. ..... 246/276
(58) Field of Search ..... 246/270 R, 275, 246/276, 468

(56) References Cited

U.S. PATENT DOCUMENTS 5,544,848 * 8/1996 Kuhn et al. ..... 246/276
5,595,361 * 1/1997 Remington et al. ..... 246/276
6,138,958 * 10/2000 Iric et al. ..... 246/276

* cited by examiner

*Primary Examiner*—Mark T. Le
(74) *Attorney, Agent, or Firm*—Thomas S. Baker, Jr.

(57) ABSTRACT

A railroad trackwork frog assembly is provided with a base plate, a spring wing rail supported by and movable laterally relative to the base plate, and a hold-down subassembly attached to the spring wing rail and to the base plate, the hold-down subassembly comprising, in combination with a horn housing, a horn element having a cross-section area moment of inertia about a transverse horizontal axis intersecting the cross-section area center of gravity that is smaller than the cross-section area moment of inertia about a transverse vertical axis intersecting the cross-section area center of gravity.

7 Claims, 4 Drawing Sheets

FIG. 2
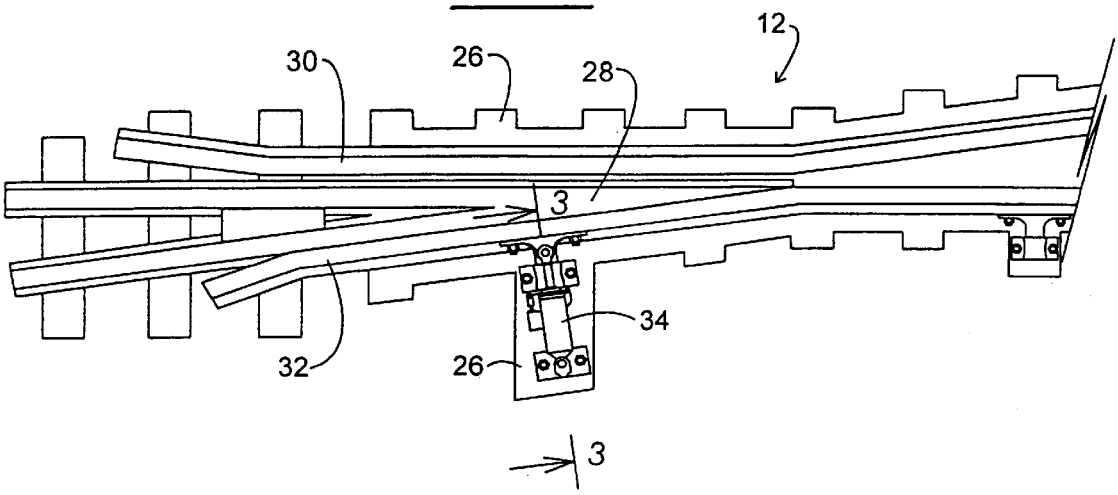
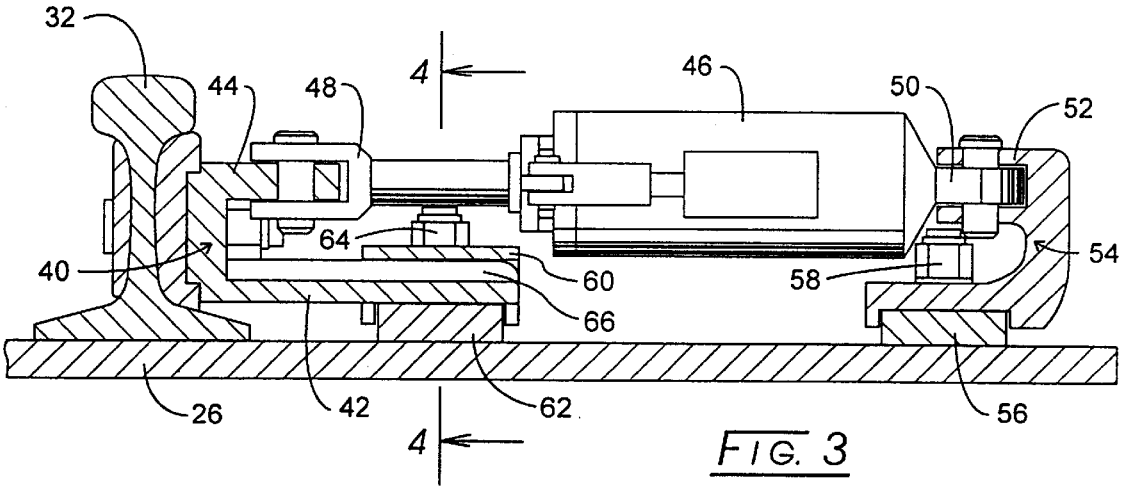
FIG. 3
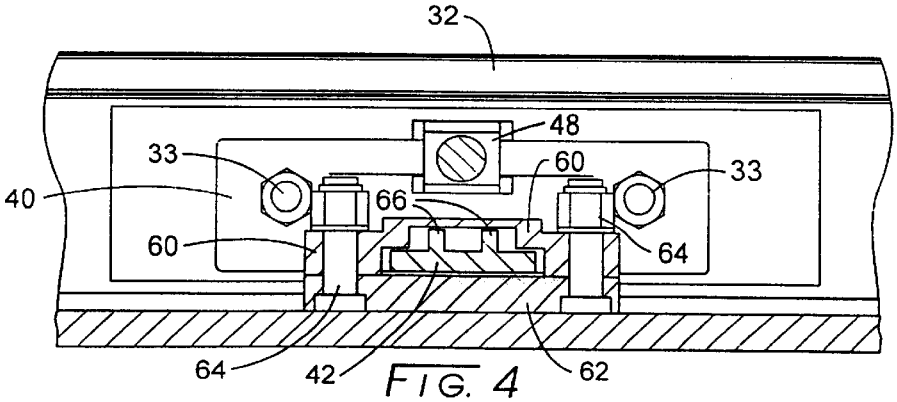
FIG. 4

RAILROAD SPRING WING FROG ASSEMBLY

CROSS-REFERENCES

None.

FIELD OF THE INVENTION

This invention relates generally to railroad system trackworks, and particularly concerns an improved railroad spring wing rail frog assembly having an advantageous low-profile, hold-open/hold-down subassembly co-operably attached to the assembly spring wing rail.

BACKGROUND OF THE INVENTIONS

It heretofore has been the practice in the United States in connection with railroad trackwork systems having spring wing rail frog assemblies with multiple adjunct devices such as conventional spring wing rail hold-down devices and conventional spring wing rail hold-open devices to mount such devices at separate but adjacent individual trackwork roadbed tie locations or on bridge plates which span the crib areas between the involved tie locations. Such practice has led to a number of relatively simple yet hazardous operating problems.

We have discovered a construction for railroad spring wing rail frog assemblies that avoids the prior practice problems and that is essentially involves low-cost to implement and especially efficient in its operation compared to a conventional hold-down and combined hold-open installation.

Other advantages and objectives of the present invention will become apparent during consideration of the descriptions which follow and the included drawings.

SUMMARY OF THE INVENTION

The frog assembly of the present invention includes a base plate element, a frog spring wing rail element supported by and laterally movable relative to the base plate element, an attach fitting rigidly secured to the spring wing rail element and having an integral low-profile hold-down horn, and a hold-open device pivotally connected to the attach fitting and positioned both immediately above and longitudinally beyond the hold-down horn to thereby provide the assembly with a low vertical profile.

BRIEF DESCRIPTION OF THE DRAWINGS

FIG. 2 is an enlarged plan view of the spring wing rail frog assembly illustrated in FIG. 1;

FIG. 3 is a section view taken at line 3—3 of FIG. 2;

FIG. 4 is a section view taken at line 4—4 of FIG. 3;

DETAILED DESCRIPTION

Figure 1:
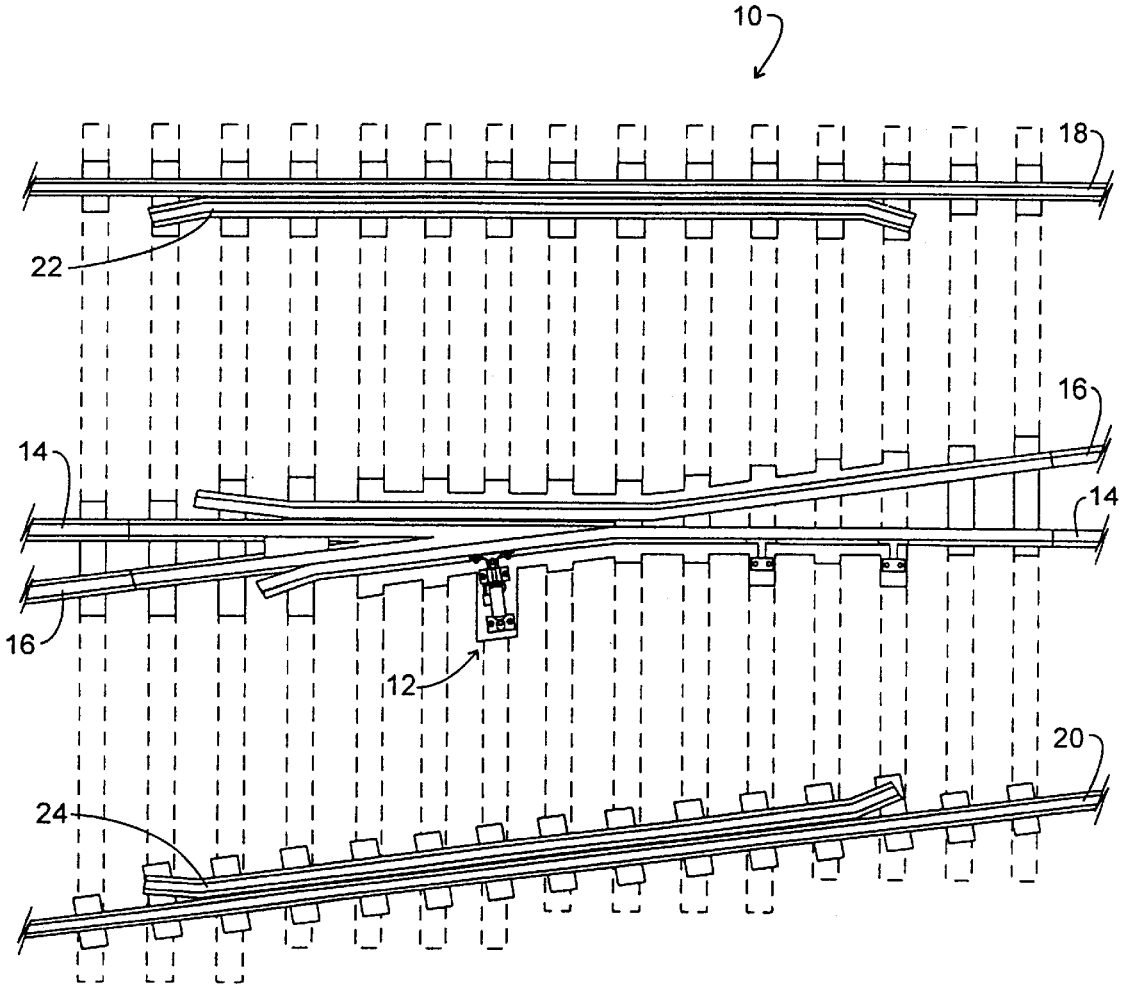
FIG. 1 is a schematic plan view of a railroad trackworks intersection incorporating the spring wing rail frog assembly of the present invention.

FIG. 1 schematically illustrates a railroad system trackworks intersection 10 having the spring wing rail frog assembly 12 of the present invention incorporated therein. Frog assembly 12 is basically a left-hand frog installed at the intersection of main line traffic rail 14 and turn-out traffic rail 16. Also included in intersection 10 are additional main-line traffic rail 18, additional turn-out traffic rail 20, and guard rails 22 and 24.

The dominant features of spring wing rail frog assembly 10 are illustrated in FIG. 2 and such assembly is basically comprised of a base plate element 26, a V-shaped frog point element 28, a fixed wing rail element 30, a spring wing rail element 32, and a hold-down and hold-open element 34. The present invention essentially focuses on the design, installation, and operational advantages of hold-down and hold-open subassembly 34.

As shown schematically in FIG. 3, subassembly 34 is basically comprised of attach fitting 40 that is removably secured to spring wing rail element 32 by threaded bolt and nut fasteners 33, and that has an integral hold-down horn element 42 and an integral connector swivel half 44 that is functionally connected to a hold-open element 46 of the type disclosed in our co-pending U.S. patent applications Ser. No. 09/251,841 filed Feb. 17, 1999, now U.S. Pat. No. 6,164,602, and U.S. Ser. No. 09/251,620 filed Feb. 17, 1999, now U.S. Pat. No. 6,158,697. The connecting rod portion of hold-open element 46 has a clevis connector swivel half 48 that co-operates with tang connector swivel half 44 of attach fitting 40. It is important to note that hold-open element 46 is positioned in axial alignment with, vertically above, and immediately adjacent to integral hold-down horn element 42 but with adequate non-interference clearance.

The end of hold-open element 46 opposite connector swivel half 48 has a tang connector swivel half 50 that co-operates with clevis connector swivel half 52 provided as an integral part of mounting bracket 54. Mounting bracket 54 is supported on a conventional bolt head capture block 56 which is weldably affixed to base plate element 26 and is rigidly secured to capture block 56 by conventional threaded bolt and nut fasteners 58.

Figure 5:
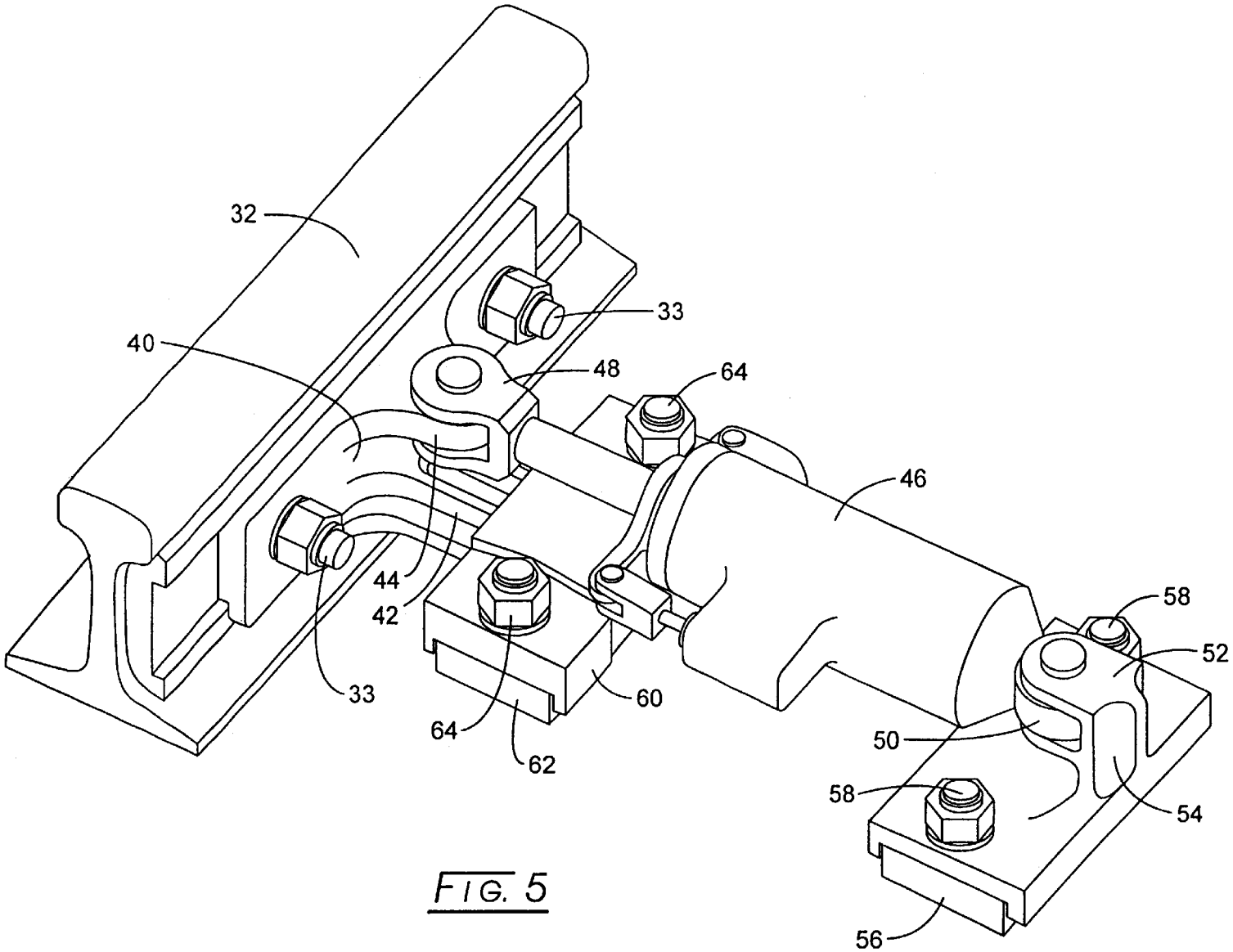
FIG. 5 is a perspective view of the combined hold-open and hold-down apparatus illustrated in FIGS. 1 through 4.

Subassembly 34 also includes a hold-down horn housing element 60 that co-operates with hold-down horn element 42 to restrain element 42 and attached spring wing rail 32 from excessive vertical movement relative to base plate element 26 during frog assembly operation but not from axially longitudinal movement. Horn housing 60 is supported upon a conventional bolt head capture block 62 which is weldably affixed to base plate element 26 and is rigidly secured to capture block 62 by conventional threaded bolt and nut fasteners 64. The bolt head portion of fasteners 58 and 64 are secured in keyhole recesses formed in capture blocks 56 and 62. It should be noted that the design of hold-down horn element 42 and hold-down horn housing element 60 depart radically from conventional practice in that element 42 is configured to be horizontally much wider and to have a cross-section area moment of inertia about the horizontal transverse axis that intersects the cross-section area center of gravity that is significantly smaller in comparison to the similar characteristic of a conventional spring wing rail hold-down horn element. To obtain a requisite degree of vertical bending stiffness it is generally advantageous to provide the hold-down horn configuration in cross-section with added integral but horizontally spaced-apart reinforcing ribs 66. See FIGS. 4, 5, and 6.

Figure 6:
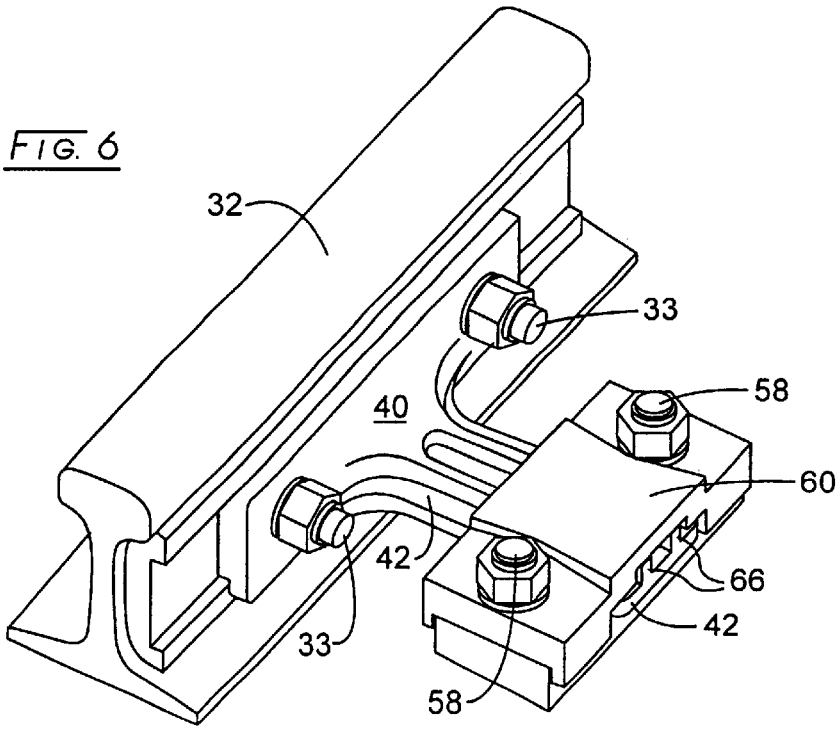
FIGS. 6 and 7 are perspective views of alternate embodiments of the invention improved hold-down device suitable for trackwork frog assembly applications not having a combined hold-open device.
Figure 7:
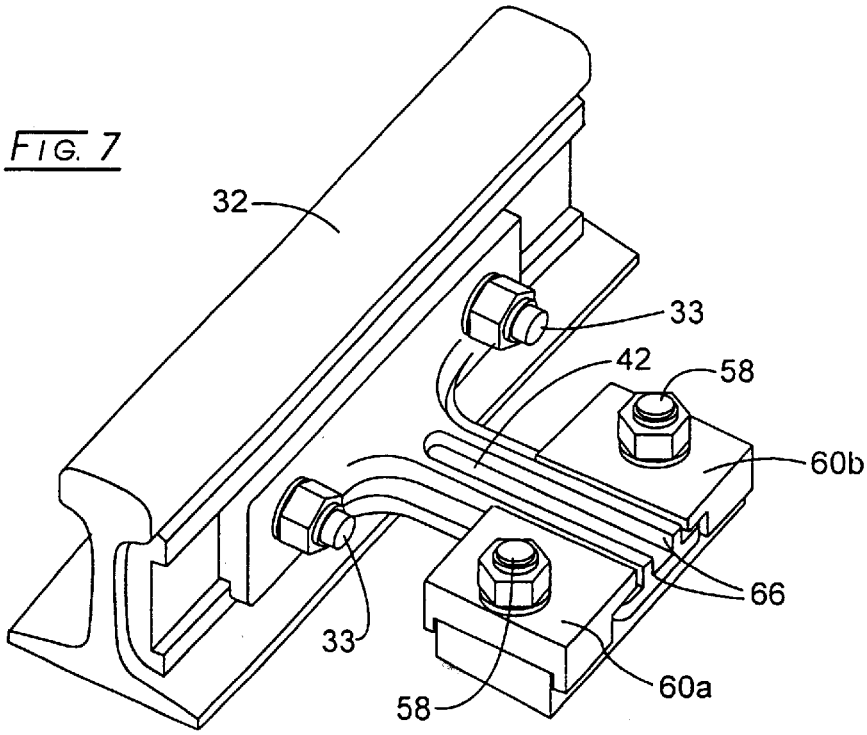

In FIGS. 6 and 7 we illustrate further variations of the invention hold-down horn and horn housing elements which can contribute significantly to obtaining a lower vertical profile for a railroad trackwork spring wing rail frog assembly that necessarily does not include a hold-open device. In both the FIG. 6 and FIG. 7 embodiments the attach fitting 40 does not include a tang element 48 for connecting to a hold-open device. In the FIG. 7 embodiment we essentially split the invention horn housing element 60 into two separate housing halves 60*a* and 60*b* that each slidably co-operates with only the upper surfaces of hold-down horn element 42 that lie outboard of integral reinforcing ribs 66 and not with the upper surfaces of those reinforcing ribs as in FIGS. 3 through 6.

Various changes may be made in the relative shapes, sizes, and materials of the component parts of the herein-described railroad spring wing rail frog assembly invention without departing from the scope, meaning, or intent of the claims which follow.

We claim as our invention:

1. In a railroad trackwork frog assembly, in combination:

a base plate element;

a spring wing rail element supported by and laterally movable relative to said base plate element;

a hold-down element affixed to and projected laterally from said spring wing rail element; and an extendible and retractable hold-open element pivotally affixed to said base plate element and to said spring wing rail element, said hold-open element being positioned vertically immediately above said hold-down element.

2. The railroad trackwork frog assembly invention defined by claim 1 wherein said hold-down element includes a horn housing element rigidly secured to said base plate element and a horn element restrained by said horn housing vertically and not longitudinally, said horn element having a cross-section area moment of inertia about a transverse horizontal axis intersecting its cross-section area center of gravity that is smaller than a cross-section area moment of inertia about a transverse vertical axis intersecting its cross-section area center of gravity.

3. The railroad trackwork frog assembly invention defined by claim 2 wherein said hold-down horn element is provided with transversely spaced-apart integral reinforcing ribs projecting vertically upward from a hold-down horn element principal upper surface, said hold-down horn housing engaging and vertically restraining uppermost surfaces of said reinforcing ribs when said spring wing rail is moved laterally with respect to said base plate element.

4. The railroad trackwork frog assembly invention defined by claim 2 wherein said hold-down horn element is provided with transversely spaced-apart integral reinforcing ribs projecting vertically upward from a hold-down horn element principal upper surface, said hold-down horn housing slidably engaging said horn element upper principal surface and not said horn element integral reinforcing ribs when said spring wing rail is moved laterally with respect to said base plate element.

5. In a railroad trackwork frog assembly, in combination:

a base plate element;

a spring wing rail element supported by and laterally movable relative to said base plate element; and a hold-down element affixed to and projected laterally form said spring wing rail element, said hold-down element including a horn housing element rigidly secured to said base plate element and a horn element restrained by said horn housing vertically and not longitudinally, said horn element having a cross-section area moment of inertia about a transverse horizontal axis intersecting its cross-section area center of gravity that is significantly smaller than a cross-section area moment of inertia about a transverse vertical axis intersecting its cross-section area center of gravity.

6. In a railroad trackwork frog assembly, in combination:

a base plate element;

a spring wing rail element supported by and laterally movable relative to said base plate element;

a hold-down element affixed to and projected laterally from said spring wing rail element, said hold-down element including a horn housing element rigidly secured to said base plate element and a horn element restrained by said horn housing vertically and not longitudinally, said horn element having a cross-section area moment of inertia about a transverse horizontal axis intersecting its cross-section area center of gravity that is smaller than a cross-section area moment of inertia about a transverse vertical axis intersecting its cross-section area center of gravity; and wherein said hold-down horn element is provided with transversely spaced-apart integral reinforcing ribs projecting vertically upward from a hold-down horn element principal upper surface, said hold-down horn housing engaging and vertically restraining uppermost surfaces of said reinforcing ribs when said spring wing rail is moved laterally with respect to said base plate element.

7. In a railroad trackwork frog assembly, in combination:

a base plate element;

a spring wing rail element supported by and laterally movable relative to said base plate element;

a hold-down element affixed to and projected laterally from said spring wing rail element, said hold-down element including a horn housing element rigidly secured to said base plate element and a horn element restrained by said horn housing vertically and not longitudinally, said horn element having a cross-section area moment of inertia about a transverse horizontal axis intersecting its cross-section area center of gravity that is smaller than a cross-section area moment of inertia about a transverse vertical axis intersecting its cross-section area center of gravity; and wherein said hold-down horn element is provided with transversely spaced-apart integral reinforcing ribs projecting vertically upward from a hold-down horn element principal upper surface, said hold-down horn housing slidably engaging said horn element upper principal surface and not said horn element integral reinforcing ribs when said spring wing rail is moved laterally with respect to said base plate element.

* * * * *